United States Patent [19]

Casella et al.

[11] Patent Number: 4,906,975

[45] Date of Patent: Mar. 6, 1990

[54] VIBRATION RESPONSIVE INTRUSION DETECTION BARRIER

[75] Inventors: Anthony J. Casella, East Williston, N.Y.; John W. Mainiero; Michael R. Mainiero, both of Sandy Hook, Conn.; Anthony R. Zagami, Carmel, N.Y.

[73] Assignee: MRM Security Systems, Inc., Waterbury, Conn.

[21] Appl. No.: 274,414

[22] Filed: Nov. 18, 1988

[51] Int. Cl.[4] ..... G08B 13/12

[52] U.S. Cl. ..... 340/566; 256/1; 340/541

[58] Field of Search ..... 340/566, 541; 256/1, 256/8, 6, 10

[56] References Cited

U.S. PATENT DOCUMENTS

| | | | |
|---|---|---|---|
| Re. 30,814 | 12/1981 | Mainiero | 72/294 |
| 2,908,484 | 10/1959 | Uhl | 256/8 |
| 3,010,701 | 11/1961 | Klemm | 256/8 |
| 3,463,455 | 8/1969 | Meckel | 256/8 |
| 3,763,482 | 10/1973 | Burney et al. | 340/564 |
| 3,947,835 | 3/1976 | Laymon | 340/566 |
| 3,956,743 | 5/1976 | Geiszler et al. | 340/538 |
| 4,028,925 | 6/1977 | Mainiero | 72/294 |
| 4,040,603 | 8/1977 | Mainiero | 256/8 |
| 4,365,239 | 12/1982 | Mongeon | 340/566 |
| 4,503,423 | 3/1985 | Mainiero et al. | 256/8 |
| 4,509,726 | 4/1985 | Boggs et al. | 256/8 |
| 4,680,573 | 7/1987 | Ciordinik et al. | 340/541 |
| 4,718,641 | 1/1988 | Mainero | 256/8 |
| 4,760,295 | 7/1988 | Macalindin | 310/27 |
| 4,777,476 | 10/1988 | Dank | 340/541 |
| 4,818,972 | 4/1989 | Mainiero et al. | 340/541 |

OTHER PUBLICATIONS

"Guardwire 300 Series" Brochure; printed in U.K.—Guardwire of Kingsfield InNdustrial Estate, Derby Road, Wirksworth, Derby, DE4 4BG, England—Complete Brochure.

*Intrusion Detection Systems* by Robert L. Barnard, 1981 (pp. 71–74).

"Peristop" Brochure—Bigotec AG, Aaron, Switzerland.

*Primary Examiner*—Glen R. Swann, III

*Attorney, Agent, or Firm*—Anthony J. Casella; Gerald E. Hespos

[57] ABSTRACT

An intrustion detection barrier is provided comprising inner and outer coils defined by helical barbed tape. The inner coil comprises a vibration-responsive intrusion detection cable securely retained and protected therein. The inner coil is supported centrally within the outer coil by radially extending supports which may be flat straps which are effective to transmit vibrations from the outer coil to the inner coil. The straps may be welded or otherwise mechanically connected to both the inner and outer coils, and may further be provided with clusters of barbs thereon.

29 Claims, 5 Drawing Sheets

VIBRATION RESPONSIVE INTRUSION DETECTION BARRIER

BACKGROUND OF THE INVENTION

Helical barbed tape is widely employed to define an elongated antipersonnel barrier that may be mounted on the ground, at the base of a fence or at the top of a supporting structure. The typical helical barbed tape comprises an elongated helically formed central support from which spaced apart clusters of barbs extend. Each cluster of barbs typically comprises a total of four barbs, with a first pair of barbs extending from a root on one side of the central support and a second pair of barbs extending from a second root on the opposite side of the central support. Each barb is an elongated generally flat member having opposed converging edges which intersect at a very sharp point. The barbs on opposed sides of the central supporting portion may be offset relative to the central support. An early version of a helical barbed tape of this general type is shown in U.S. Pat. No. 3,463,455 which issued to Meckel. Helical barbed tapes of the general type shown in U.S. Pat. No. 3,463,455 have received very substantial commercial success in view of their exceptional performance as an antipersonnel barrier.

Several improvements to the original Meckel barbed tape configuration have been made in recent years. In particular, double coil barbed tape barriers have been developed comprising an outer coil defining a helix having a first pitch and an inner coil defining a helix having a second pitch. The inner coil has been suspended generally centrally within the outer coil by a plurality of multistrand twisted cables extending therebetween. The use of inner and outer coils defining different respective pitches creates a substantially enhanced antipersonnel barrier. In particular, an intruder attempting to move between adjacent loops of the outer coil is likely to be stopped by the inner coil.

Another attempt to improve the basic structure of Meckel's U.S. Pat. No. 3,463,455 is shown in U.S. Pat. No. 4,503,423 which issued to Joseph J. Mainiero et al on March 5, 1985. In particular, U.S. Pat. No. 4,503,423 shows a single coil structure wherein adjacent loops in the coil are welded to one another at a plurality of spaced apart locations about each loop. The weldment between adjacent turns on the helical barbed tape is intended to continuously maintain opposed major surfaces of adjacent turns of the coil in abutting face-to-face surface contact to prevent longitudinal, radial or pivotal movement of adjacent turns relative to one another at the attachment points. The rigid permanent weldment of adjacent coils at a plurality of such attachment points defines a barrier much like the old concertina barrier which is intended to prevent intruders from slipping between adjacent coils.

Many helical barbed tape products include a helically extending reinforcing wire about which the central helical support of the barbed tape is wrapped. An early version of a barbed tape product of this general type is shown in U.S. Pat. No. 2,908,484 which issued to Uhl on October 13, 1959. The typical barbed tape product of this general type is manufactured by first wrapping a longitudinally extending barbed tape around the reinforcing wire, and then forming the combined tape and reinforcing wire into a helical configuration.

Several other improvements to helical barbed tape antipersonnel barriers have recently been made. For example, U.S. Pat. No. 4,718,641 which issued to Michael R. Mainiero on January 12, 1988 and which is asigned to the assignee of the subject application is directed to a helical barbed tape with reinforced barbs. The reinforcements formed in the barbs, as shown in U.S. Pat. No. 4,718,641, substantially increase the strength of the barbs, and thereby enable the use of a thinner gauge metal with no negative effects on the performance of the barbed tape. U.S. Pat. No. 4,718,641 also shows that a reinforcing wire can be used in combination with the barbed tape with reinforced barbs. The reinforcing wire provides further support for the central supporting portion of the barbed tape, thereby further ensuring the specified performance of the product even with a thinner gauge metal material for the tape.

The intrusion prevention art further includes electronic detection devices. In particular, it has been considered desirable to combine the physical barriers provided by helical barbed tape with an electronic detection means such that an attempt to breach the physical barrier will be electronically detected. The typical breach that should be protected against should include attempts to pass between coils, to cut the helical barbed tape and/or to crush the barrier with wooden planks, vehicles or the like.

One attempt to combine electronic intrusion detection devices with a barbed tape is shown in the above referenced U.S. Pat. No. 4,503,423. In particular, U.S. Pat. No. 4,503,423 attempts to use the helical barbed tape as a wave guide. A microwave transmitter is disposed at one end of the elongated helical barbed tape shown in U.S. Pat. No. 4,503,423 and directs a signal generally centrally through the helix defined by the barbed tape. A receiver is disposed at the other end of the barbed tape to receive the microwave signals from the transmitter. Variations in the received microwave signal may be indicative of an intrusion attempt.

Another prior art attempt to combine intrusion detection into an antipersonnel barrier is shown in U.S. Pat. No. 4,680,573 which issued to Ciordinik et al on July 14, 1987. Ciordinik shows a single coil barbed tape similar to the above referenced Uhl structure. However, the reinforcing wire shown in the single coil of U.S. Pat. No. 4,680,573 includes an electrical or optical conductor. The signal carried by the electrical or optical conductor will be varied or broken if the barbed tape or barbed wire is cut or crushed. Although the apparatus shown in U.S. Pat. No. 4,680,573 may be effective for detecting certain types of breaches to the antipersonnel barrier, it will be ineffective for detecting any type of breach that does not cut or substantially crush the wire.

The prior art also includes the combination of a standard chain link or barbed wire fence in combination with a linear length of coaxial cable transducer extending along the length of the fence and capable of producing an alarm when an intrusion or compromise of the fence is attempted. This prior art teaching is shown, for example, in U.S. Pat. No. 3,763,482 which issued to Burney et al on October 2, 1973. The apparatus shown in U.S. Pat. No. 3,763,482 includes a coaxial cable with a dielectric filler comprising a radially polarized electret which develops and transmits a signal along the cable in response to deformations of the cable at any point along its length. In particular, the cable shown in U.S. Pat. No. 3,763,482 may be clamped to a chain link or barbed wire fence in a generally linear disposition to generate an electrical signal in response to an attempt by an intruder to climb or cut the fence.

Still another prior art system is marketed under the trademark "PERISTOP" by Bigotec AG of Aaron, Switzerland, and comprises a galvanized hollow steel wire containing an insulated copper conductor. The "PERISTOP" wire may be installed inside a conventional barbed tape concertina. The "PERISTOP" apparatus is similar to the above referenced U.S. Pat. No. 4,680,573 to Ciordinik et al in that it is responsive only to the destruction or cutting of the wire.

U.S. Pat. No. 4,818,972 is a continuation-in-part of the above referenced U.S. Pat. No. 4,718,641 and was filed by the inventors herein and is assigned to the assignee of the subject invention. U.S. Pat. No. 4,818,972 shows the helical barbed tape with reinforced barbs and further including a central vibration-sensitive reinforcing cable, such as an electret cable, a piezoelectric cable or a vibration-sensitive geophone transducer cable. A general discussion of vibration-sensitive electret coaxial cables, geophone transducer cables or piezo-electric transducer cables is provided in *Intrusion Detection Systems Principles of Operation and Application* by Robert L. Barnard which was published in 1981 by Butterworth Incorporated of Woburn, Massachusetts.

Despite the desirable features found in certain of the above reference helical barbed tape antipersonnel barriers and certain electronic detection systems, it is desired to provide significant advances in the combination of these two art areas. In particular, the prior art electronic intrusion detection systems generally did not perform adequately as an antipersonnel barrier, while most prior art helical barbed tapes did not provide adequate detection of attempts to breach the physical barrier. With the exception of the above referenced copending application Ser. No. 125,471, the prior art attempts to combine intrusion detection with helical barbed tape antipersonnel barriers have been responsive to cuts in the helical barbed tape and/or complete crushing of the helical barbed tape, but not to most other attempts to breach the physical barrier. Some other prior art attempts to marry these two technologies, such as the wave guide in the above referenced U.S. Pat. No. 4,503,423, have provided structures that would perform under laboratory conditions, but which were impractical when applied in the field.

In view of the above, it is an object of the subject invention to provide an effective antipersonnel barrier that is operative to detect attempts to breach the physical barrier.

Another object of the subject invention is to provide an antipersonnel barrier that is responsive to cuts and crushing of the wire as well as any significant movement within the barrier.

It is an additional object of the subject invention to provide an intrusion detection system wherein an intrusion detection wire is physically protected by an array of antipersonnel barriers.

Still another object of the subject invention is to provide an antipersonnel barrier and intrusion detection system wherein the intrusion detection portions of the system are supported relative to the system for preventing false alarms.

Yet another object of the subject invention is to provide an antipersonnel barrier and intrusion detection system wherein the sensitivity of the intrusion detection system is readily adjustable.

It is a further object of the subject invention to provide an antipersonnel barrier that is easily and inexpensively manufactured and installed.

Another object of the subject invention is to provide an intrusion detection system wherein electronic components are protected from environmental moisture.

SUMMARY OF THE INVENTION

The subject invention is directed to a helical barbed tape which comprises a vibration-sensitive cable as a central reinforcing wire. The vibration-sensitive cable may be one of the known types of cables, including electret coaxial cables, geophone transducer cables, piezoelectric transducer cables and others. The preferred vibration-sensitive cable, as explained in greater detail herein, employs linear induction means to sense vibrations. The vibration-sensitive cable is surrounded by the central supporting portion of the elongated helically formed barbed tape. The vibration-sensitive cable may be at least partly surrounded by a filler material disposed intermediate the cable and the central supporting portion of the helical barbed tape. The filler material may be a silicone or other such initially flowable material. The filler helps transmit vibrations to the cable and prevents the accumulation of water or corrosive environmental deposits between the vibration-sensitive cable and the helical barbed tape. In some environments, the accumulation of moisture or corrosives could cause a degradation of the product and/or its performance. The helical barbed tape with the vibration sensitive cable therein may be used independently or may be attached to another structure, fence or barrier.

In a preferred embodiment, the subject invention is directed to a double coil helical barbed tape comprising an outer coil and an inner coil supported generally centrally within the outer coil. The inner coil comprises the vibration sensitive cable as explained above. The inner coil may define a pitch which is greater than the pitch defined by the outer coil. Additionally, the inner coil may define a helix generated in the opposite direction from the helix of the outer coil.

The outer coil preferably is defined by a helical barbed tape having a generally flat or slightly arched central supporting portion from which spaced apart clusters of barbs extend. Thus, the central supporting portion of the outer coil need not be wrapped around a reinforcing wire. The pitch of the outer coil may be controlled by spacer wires and/or by connecting means for generally holding adjacent coils in proximity to one another at a plurality of locations about each loop. In particular, the connecting means between adjacent loops may define a substantially rigid connection, such as welding, or mechanical means for providing a less rigid connection and/or a controlled amount of movement at selected points between adjacent loops.

The inner helical barbed tape with the vibration-sensitive cable securely mounted therein may be supported relative to the outer coil of helical tape by a plurality of strap means extending in generally radial directions between the inner and outer barbed tapes. The strap means may be welded to both the inner and outer barbed tapes or mechanically connected to at least one of the inner and outer helical barbed tapes. The strap means or other such means supporting the inner helical barbed tape within the outer helical barbed tape may also define the connection means between adjacent loops of the outer helical barbed tape.

The apparatus of the subject invention may further comprise electrical signal processing means for identifying vibration-related signals generated by the vibration-sensitive cables within the helical barbed tape. The electrical means may be variable to adjust the sensitivity of the apparatus. The subject invention may further comprise alarm means for generating alarm signals in response to signals sensed by the vibration-sensitive cable. The alarm means may be operative to identify a particular location of a sensed vibration signal.

The subject invention is further directed to a method for making a helical barbed tape with a vibration sensitive cable therein. The method comprises the step of forming an elongated channel in the blanked tape. A filler material is then urged into the channel in a metered amount. The vibration sensitive cable is then laid in the channel and the channel is formed substantially around the cable, such that the cable is supported relative to the barbed tape by the filler. The filler is metered to substantially fill all voids and to enhance the transmission of vibrations from the tape to the cable. The method steps may be carried out simultaneously at a plurality of spaced apart locations to define a continuous method.

DETAILED DESCRIPTION OF THE PREFERRED EMBODIMENTS

Figure 1:
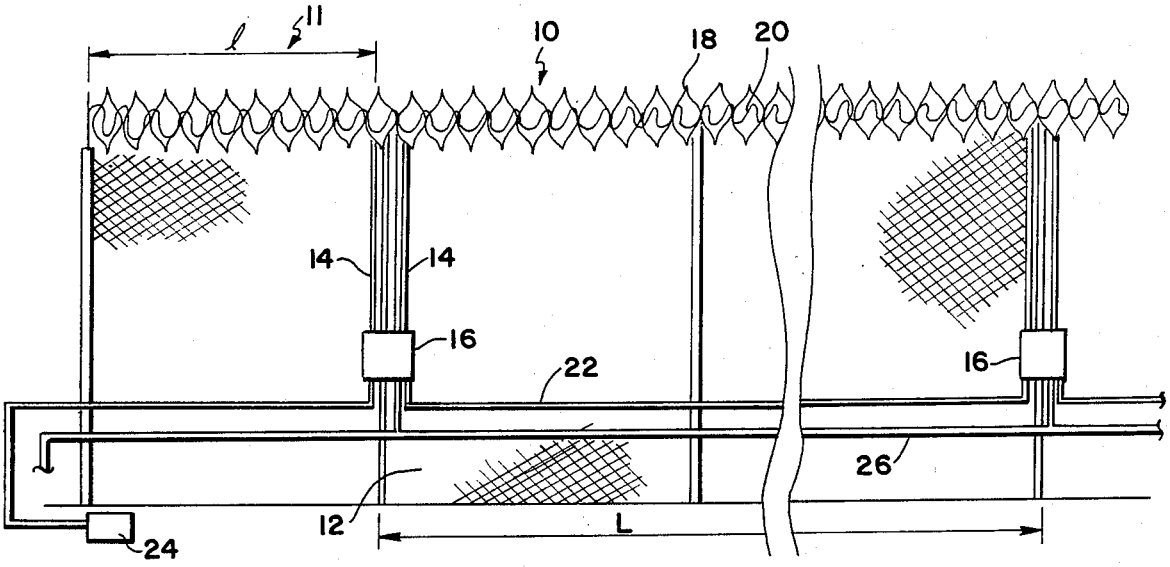
FIG. 1 is a front plan view of a fence to which an intrusion detection barrier in accordance with the subject invention is mounted.

The intrusion detection barrier of the subject invention is illustrated in FIGS. 1–4 and is identified generally by the numeral 10. In particular, the intrusion detection barrier 10, as shown in FIG. 1, is mounted to the top portion of a chain link fence 12. Lead-in cables 14 extend between the intrusion detection barrier 10 and signal processor 16. The processor 16 is generally operative to receive, process and transmit signals corresponding to an intrusion or attempted intrusion relative to the intrusion detection barrier 10. The signal processor 16 preferably is powered by a twelve volt DC power supply with a maximum loading of one watt. Power supplies and electronic controls for the signal processor 16 preferably are shielded from the sensing cable in the intrusion detection barrier 10 to minimize the possible effects of EMI between the power and signal systems.

The processor 16 includes means for calibrating and adjusting: the system sensitivity; the number of counts required above the selected threshold before one intrusion event is deemed to have occurred; the number of events that must occur before an alarm condition is declared; and the length of time that must expire before the first event discard occurs. The processor 16 provides independent alarm and tamper relay outputs. Relays are normally open so that any system failure causes an alarm condition. The tamper relay activates if interference with the signal processor 16 or the intrusion detection barrier 10 occurs. A tamper condition may also cause an audible tone to be sounded through an audio monitoring circuit. The signal processor 16 preferably is housed in a watertight enclosure manufactured from a rigid material such as 14-gauge steel with continuously welded seams. The cover preferably is furnished with a water-resistant gasket and quick-release latches.

FIG. 1 depicts two signal processors 16 being mounted to the fence 12. The typical spacing "L" between adjacent signal processors 16 preferably will be approximately one thousand feet. The intrusion detection barrier 10 extending between adjacent signal processors 16 typically will comprise a plurality of separate modules 11 which are electrically and mechanically connected to one another as explained in greater detail below. Each module 11 defining the intrusion detection barrier 10 preferably will extend a length "l" of approximately fifty feet, with each fifty-foot module of the intrusion detection barrier 10 comprising an outer coil 18 having 101 loops per module and an inner coil 20 which preferably is of a different pitch and is generated in an opposite direction. In particular, the inner coil 20 preferably defines a greater pitch such that fewer loops of the inner coil 20 are disposed within each module defining the intrusion detection barrier 10.

Sensor cables 22 extend between adjacent signal processors 16 and to a central alarm processor 24. The central alarm processor 24 typically will be located in a central control station and will comprise a map display which is operative to visually identify the zone in which a sensed security breach occurs. The sensor cable 22 preferably is disposed within a rigid tube to discourage tampering, even though any such tampering attempt would generate an alarm. The system depicted in FIG. 1 further comprises electronic power lines 26 extending from a power source (not shown) to each of the respective signal processors 16. The power lines 26 are separated from the sensor cables 22 to further minimize the possible effects of induced EMI in the sensor cable upon the electronic processing circuitry.

Figure 2:
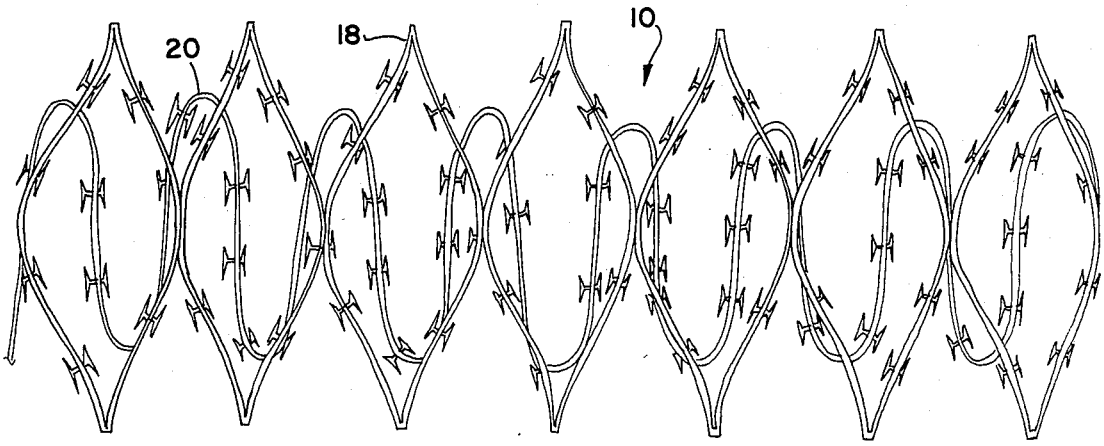
FIG. 2 is a front plan view of the intrusion detection barrier of the subject invention.
Figure 3:
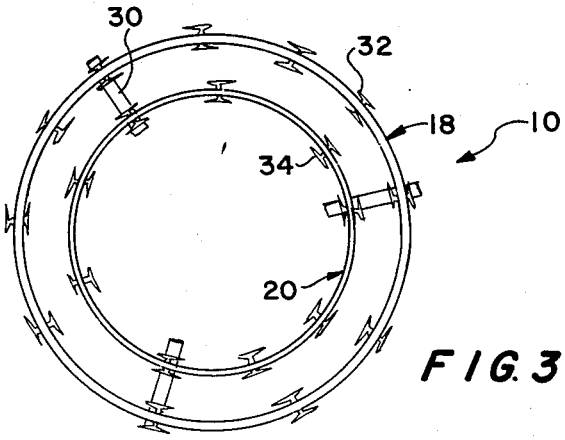
FIG. 3 is an end view of the intrusion detection barrier shown in FIG. 2.
Figure 4:
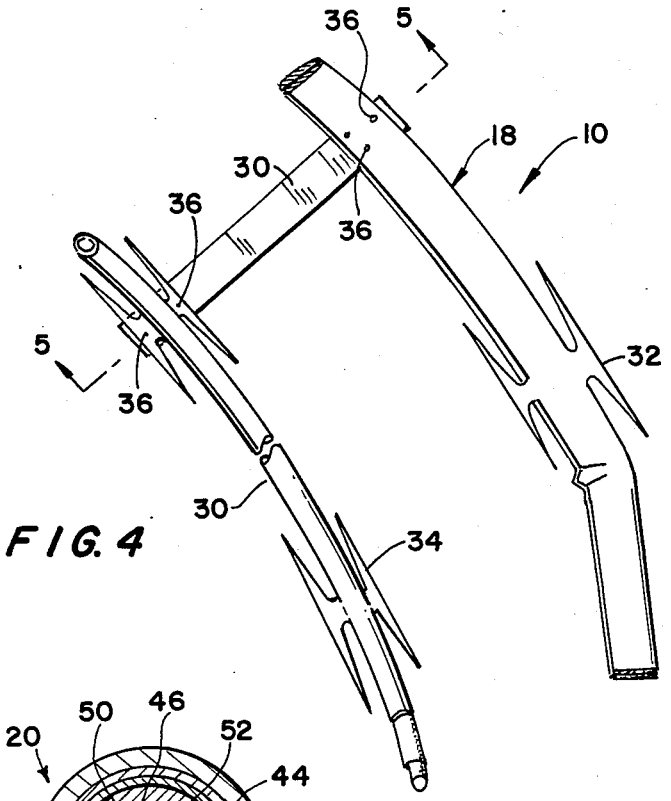
FIG. 4 is an elevational view showing a portion of the intrusion detection barrier of FIG. 3.
Figure 5:
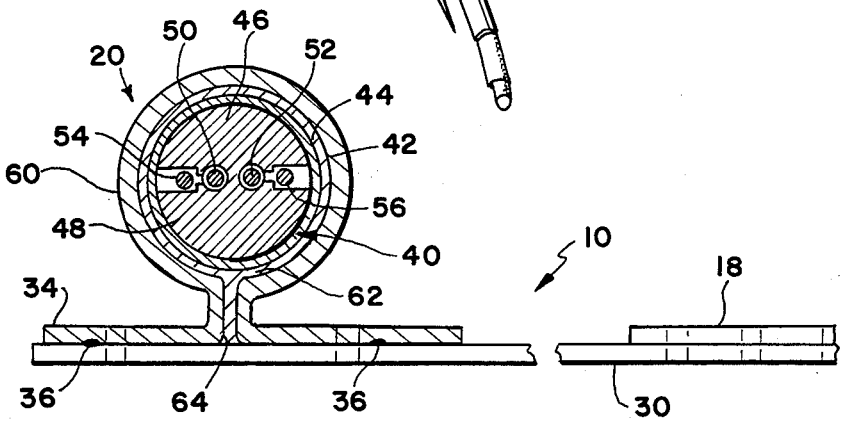
FIG. 5 is cross-sectional view taken along line 5—5 in FIG. 4 and showing the vibration-sensitive cable incorporated into the inner helical barbed tape.
Figure 6:
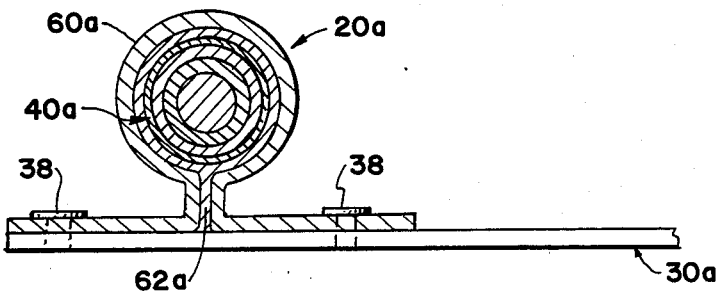
FIG. 6 is a cross-sectional view similar to FIG. 5, but showing an alternate vibration-sensitive cable incorporated into the inner helical barbed tape.

As shown more clearly in FIGS. 2 and 3, the inner coil 20 is supported generally centrally within the outer coil 18 by a plurality of generally radially extending connecting straps 30. The straps 30 define generally flat strips of metal which are aligned in generally radial directions and which are connected to both the outer coil 18 and the inner coil 20 at a plurality of locations about the circumferences of the respective outer and inner coils 18 and 20 and at spaced apart locations therealong. As depicted in FIGS. 3–5, the straps 30 are secured by weldments 36 to the respective outer and inner coils 18 and 20. Alternatively, the straps 30 may be connected by rivets 38 as shown in FIG. 6 or by other mechanical means as described and illustrated further below. The weldments 36 for securing the straps 30 to the outer coil 18 as shown in FIG. 5 may be at locations either in line with or between adjacent barb clusters 32. Preferably, as shown in FIG. 4, the strap 30 is secured to the outer coil 18 at locations thereon intermediate adjacent barb clusters 32. However, as shown most clearly in FIG. 4 to ensure an adequate surface to which the strap 30 may be affixed, and to ensure that weldments do not damage the vibration-sensitive cable within the inner coil 20, the strap 30 preferably is welded at the barb clusters 34 on the inner coil 20 rather than at locations between barb clusters 34.

The flat straps 30 supporting the inner coil 20 within the outer coil 18 efficiently transmit vibrations from the outer coil 18 to the inner coil 20 carrying the vibration-sensitive cable therein. In particular, the vibrations associated with even a slight contact against the outer coil 18 will be readily transmitted by straps 30 to the vibration-sensitive cable within the inner coil 20, thereby corresponding to a signal which can generate an alarm depending on the parameters established by the signal processors 16 and the central processor 24. The flat straps 30 have been found to be much more effective in transmitting vibrations than other connections, such as standard round cables. The greater effectiveness is believed to be attributable to the fact that round cables are more likely to dampen vibrations by twisting, stretching or the like. In contrast, the flat straps 30 shown in FIGS. 2–6 are extremely efficient in transmitting vibrations and exhibit a very small tendency to dampen these vibrations.

The vibration-sensitive cable incorporated into the center coil 20 may take any of a plurality of forms, including but not limited to geophone transducers, piezoelectric cables and coaxial electret cables. The preferred assembly, however, as depicted in FIG. 5, employs a vibration-sensitive cable 40 which comprises an outer insulating sheath 42, a metallic screening 44 disposed interiorly relative to the outer sheath 42 and a pair of opposed generally semicylindrical flexible magnetic cores 46 and 48. A pair of balanced conductor wires 50 and 52 are fixedly mounted in generally central positions relative to the magnetic cores 46 and 48. However, inductor wires 54 and 56 are mounted generally parallel to the conductor wires 50 and 52 and on opposite sides thereof. The inductor wires 54 and 56 are free to move in an air gap between the opposed flexible magnetic cores 46 and 48. The movement of the inductor wires 54 and 56 relative to the magnetic cores 46 and 48 and relative to the fixed conductor wires 50 and 52 is operative to generate a detectable signal. Even minor vibrations of the inner coil 20 will cause a movement of the inductor wires 54 and 56 sufficient to generate a signal. The vibration-sensitive cable 40 may be a GUARDWIRE 300 Series cable which is manufactured by Guardwire of Derby, England.

The entire cable 40 is securely retained within the central supporting portion 60 of the inner coil 20. In particular, the inner coil 20 is formed from an initially planar strip of metal which is blanked to define barb clusters 34 and then formed around the cable 40. An elastomeric filler material 62, such as silicone, is inserted into the space intermediate the formed supporting portion 60 of the inner coil 20 and the vibration-sensitive cable 40. The elastomeric material may be inserted in a generally flowable form as part of the forming of the support portion 60 and prior to placement the cable 40 therein. The support portion 60 is then completely closed around the vibration-sensitive cable 40, such that the filler 62 is urged substantially entirely around the cable 40. Excess elastomeric filler material 62 may be flushed or otherwise removed from external areas of the inner coil 20 prior to curing of the initially flowable elastomeric filler material 62. The elastomeric filler material 62 is disposed to lie generally between the cable 40 and the generally open portion 64 of the inner coil 20 adjacent the barb cluster 34 thereof. Elastomeric filler material 62 also preferably is urged into the space between the arcuate portion of the support 60 and the vibration-sensitive cable 40. The elastomeric filler material 62 functions to prevent water or corrosive materials from seeping into the area between the inner coil support portion 60 and the cable 40. Liquids such as water could freeze and expand within the small gaps between the cable 40 and the inner coil support 60 thereby causing damage to the cable 40 or the support 60 of the inner coil 20 and/or generating false signals. In addition to preventing the entry of liquids, the filler material has been found to enhance the transmission of vibrations to the cable 40. In particular, by filling all voids, any movement of the inner coil 20 will necessarily be transmitted to the cable 40.

FIG. 6 shows an inner coil 20*a* connected to a strap 30*a*. The inner coil 20*a* comprises a vibration-sensitive coaxial electret cable 40*a* which is retained within the generally cylindrical central supporting portion 60*a* of the barbed tape 20*a*. An elastomeric filler material 62*a* is disposed intermediate the coaxial electret cable 40*a* and the central supporting portion 60*a* of the inner coil 20*a*. As with the previously described embodiment, vibrations are transmitted through the strap 30*a* to the inner coil 20*a*. The coaxial electret cable 40*a* is operative to sense the vibrations transmitted through the strap 30*a* and generate an appropriate alarm signal.

Figure 7:
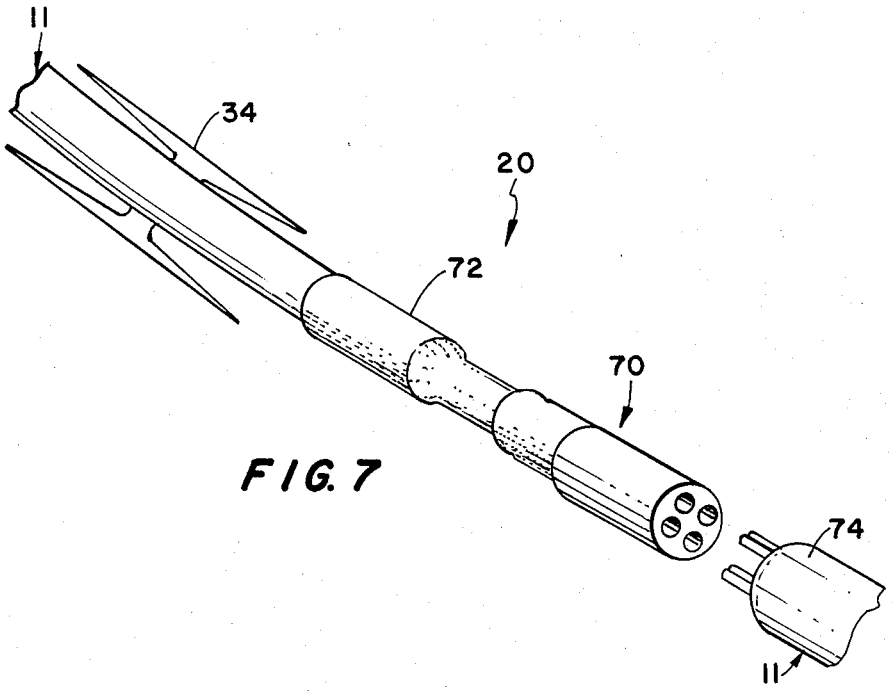
FIG. 7 is a perspective view showing an end of the helical barbed tape for electrically connecting the vibration-sensitive cable therein to another signal transmitting cable.

As noted above, a plurality of intrusion detection barrier modules 11 are interconnected to define the continuous intrusion detection barrier 10. To facilitate handling and installation of each intrusion detection module 11, the overall extended length thereof generally will be limited to approximately fifty feet. A plurality of the extended fifty-foot long modules 11 will be mechanically interconnected at the outer coils 18 thereof and both electrically and mechanically interconnected at the inner coils 20. In particular, the barbed tape of the inner coil preferably will be scored at a location approximately two inches from each opposed end, prior to wrapping the barbed tape of the inner coil 20 around the cable 40 thereof. After the barbed tape of the inner coil 20 has been formed around the cable 40, the extreme axial ends will be flexed sufficiently to break the tape at the score and permit the extreme end of the tape to be removed from the cable 40. The cable 40 is then terminated to an electrical connector 70 as shown in FIG. 7. The interconnection of the cable within the inner coil 20 and the connector 70 preferably is rendered splashproof by an elastomeric or heat shrinkable sheath 72 which will closely conform to the inner coil 20 and the connector 70 for preventing environmental or water-related damage to the system. A mateable connector 74 is similarly connected to the opposed ends of each module 11 defining inner coil 20. Thus, opposed ends of the inner coils 20 in adjacent modules 11 can be mechanically and electrically interconnected by merely interengaging the electrical connectors 70 and 74 of two adjacent inner coils 20.

Figure 8:
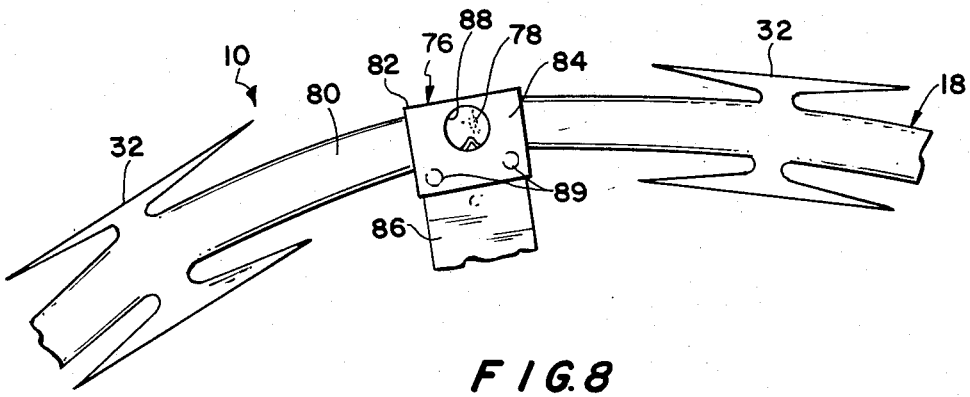
FIG. 8 is a top plan view of a strap mounted to the outer coil of helical barbed tape.

As noted above, adjacent loops of the outer coil 20 may be mechanically connected to one another to create a concertina-like structure. It is known to connect adjacent loops of the outer coil 18 together by welding. However, the welding of the adjacent loops of the outer coil 18 is a labor intensive process, with the possibility of the associated heat causing a local weakening or damage to the outer coil 18. Also, as noted above, the subject apparatus provides generally flat straps for supporting the inner coil 20 within the outer coil 18. FIG. 8 shows the use of mechanical clips 76 that can be used for holding adjacent loops of the outer coil 18 in generally close proximity to one another to create the concertina effect. In particular, the bending of the outer coil 18 into the helical configuration creates periodic folds 78 in the central supporting portion 80 of the outer coil 18. The folds 78 extend away from the generally arched central portion 78 between adjacent barb clusters 32. FIG. 8 depicts a clip 76 which is folded about a score line 82 to define opposed flaps 84 and 86. The flap 84 includes a punched hole 88 extended therethrough and dimensioned to engage the fold 78 in the barbed tape 18. The flap 86 includes an identical hole (not shown) to enable a tight nesting of adjacent loops of the outer coil 18 during storage. The opposed portions 84 and 86 may be folded about the barbed tape 18 such that the aperture 88 engages the fold 78. The opposed portions 84 and 86 of the clip 76 may be connected to one another by mechanical means or weldments 89 for holding adjacent loops of the outer coil 18 to one another at a plurality of locations about the perimeter of the outer coil 18. At selected locations, the portion 86 of the clip 80 may define an elongated strap which extends a sufficient radial distance inwardly to permit secure engagement with the inner coil for supporting the inner coil within the outer coil 18.

Figure 9:
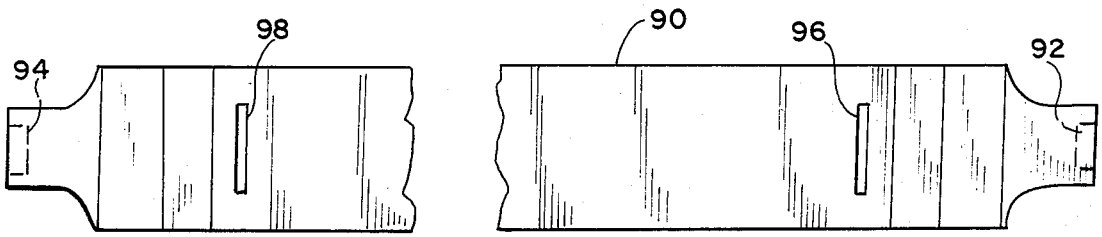
FIG. 9 is a top plan view of an alternate strap for supporting the inner helical barbed tape within the outer helical barbed tape.
Figure 10:
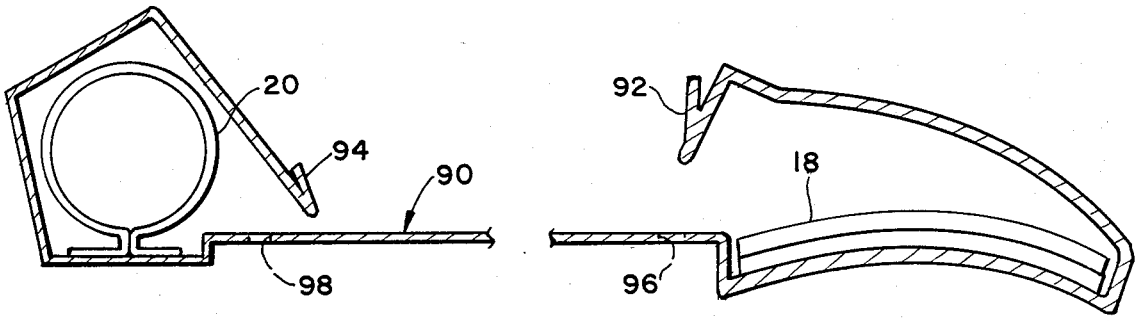
FIG. 10 is a cross-sectional view of the alternate strap being mounted to the inner and outer helical barbed tape.
Figure 11:
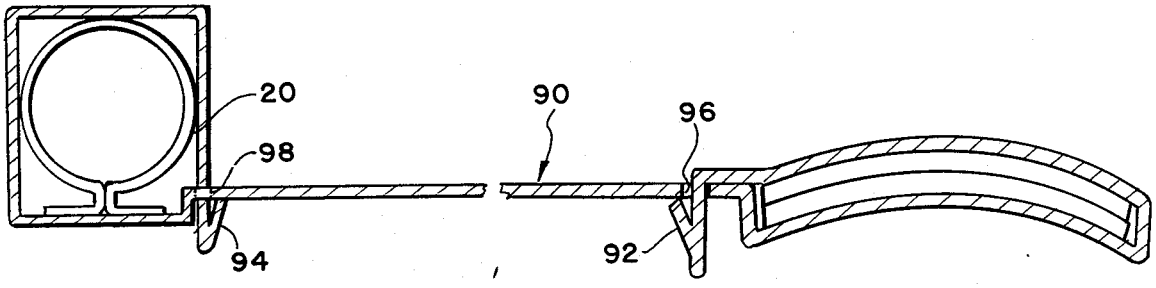
FIG. 11 is a cross-sectional view showing the alternate strap in a fully mounted condition.

FIGS. 9–11 show one particular embodiment of a strap 90 relying completely upon mechanical connection means which enable the strap 90 to mechanically support the inner coil 20 within the outer coil 18. In particular, the strap 90 is formed to include deflectable locking tangs 92 and 94 generally adjacent each opposed end thereof. The strap 90 further comprises locking apertures 96 and 98 disposed intermediate the deflectable locking tangs 92 and 94 thereof, and a plurality of score lines defining locations about which the strap 90 can be bent. As shown most clearly in FIGS. 10 and 11, the strap 90 can be formed about both the outer and inner coils 18 and 20. The locking engagement of the tang 92 in the locking aperture 96 of the strap 90 will securely retain the strap 90 to a pair of adjacent loops of the outer coil 18, thereby simultaneously holding the adjacent loops of the outer coil 18 in close proximity to one another for achieving the desired concertina configuration. In a similar manner, the locking tang 94 can be inserted into the aperture 98, with the portions therebetween securely engaging the inner coil 20. Thus, the inner coil 20 will be securely supported generally centrally within the outer coil 18 by the strap 90. The mechanical connection of the strap 90 to the outer and inner coils 18 and 20 can be readily carried out with automated or manual tools.

Figure 12:
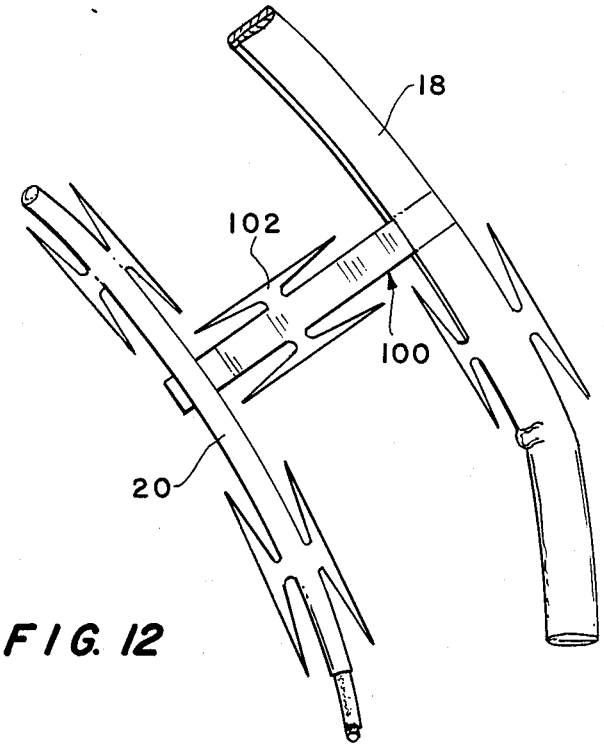
FIG. 12 is an elevational view similar to FIG. 4 but showing an alternate strap.

As depicted above, the strap 30 or 90 was a generally planar structure with longitudinally extending parallel sides. FIG. 12 shows an alternate strap embodiment 100 for supporting the inner coil 20 within the outer coil 18. The strap 100 differs from the straps 30 and 90 described above in that it is provided with a cluster 102 of offset barbs. The strap 100 performs the same supporting function of the straps 30 and 90 described above. Additionally, the strap 100 may be connected to the outer and inner coils 18 and 20 by welding or by purely mechanical interconnection as explained above. However, the cluster of barbs 102 provides an additional measure of protection for preventing any attempted breach of the intrusion detection barrier 10 or any attempt to tamper with the cables disposed within the inner coil 20.

Figure 13:
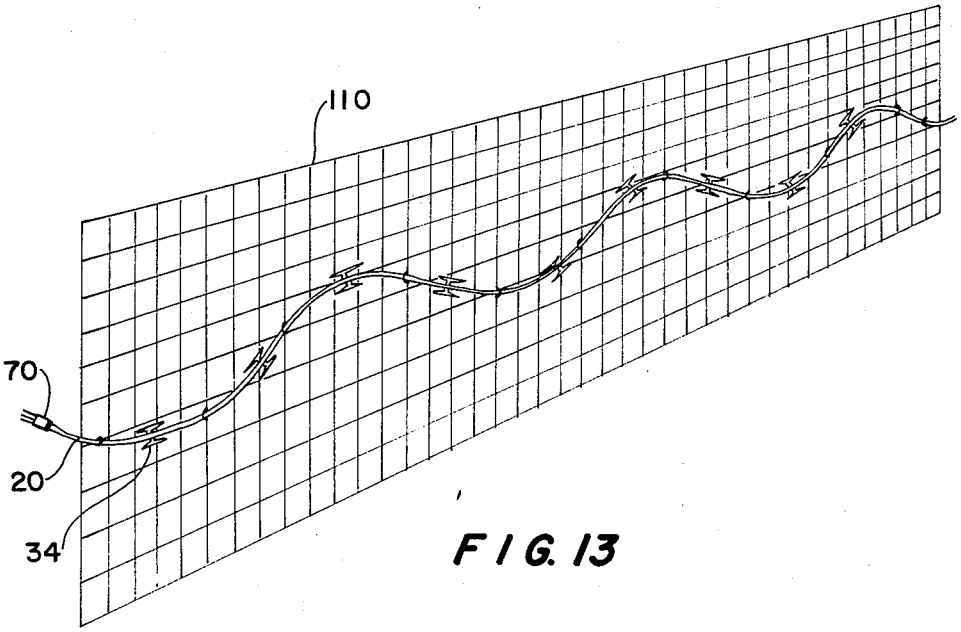
FIG. 13 is a perspective view of an alternate embodiment of an intrusion detection barrier.

FIG. 13 shows coil 20 described and illustrated above mounted to a fence 110. The fence 110 is depicted as being of a turkey-wire mesh construction. However, checken wire, chain link or other support structures would be acceptable.

In summary, an intrusion detection barrier is provided for providing both a superior antipersonnel barrier and for accurately detecting any attempted intrusion. The intrusion detection barrier comprises inner and outer coils defined by helical barbed tape. The inner coil may define a different pitch from the outer coil and may be generated in an opposite direction. Adjacent loops of the outer coil may be retained in proximity to one another to define a concertina-like construction. The inner coil is provided with a vibration-sensitive cable incorporated therein. In particular, the central supporting portion of the inner coil is formed around an electrical cable that is sensitive to vibrations. The inner coil preferably is supported relative to the outer coil by a plurality of generally flat metal straps extending therebetween. The straps are effective in transmitting vibrations in the outer coil to the inner coil, with the vibrations generating a signal through the vibration-sensitive cable retained within the inner coil. The straps may be welded or otherwise mechanically connected to both the outer and inner coils. The straps may further be provided with at least one cluster of barbs thereon for further security protection.

While the invention has been described with respect to certain preferred embodiments, it is apparent that various changes can be made without departing from the scope of the invention. In particular, other means for supporting the inner coil within the outer coil may be provided. Additionally, intrusion detection cables other than those specifically described herein may also be provided. Similarly, the construction of the specific illustrated embodiments. The subject intrusion detection barrier further will typically be employed in combination with other intrusion detection and antipersonnel barrier means.

We claim:

1. An intrusion detection barrier apparatus comprising:

an outer coil having a plurality of barb clusters thereon;

an inner coil of smaller radius than said outer coil and being disposed within said outer coil, said inner coil comprising a vibration-sensitive cable and a supporting tape formed around said cable, a plurality of barb clusters extending from said supporting tape at a plurality of spaced apart locations therealong; and a plurality of generally radially extending supporting means for supporting said inner coil generally centrally within said outer coil, whereby vibrations of said outer coil are transmitted through said supporting means and are sensed by the vibration-sensitive cable retained in said inner coil, and whereby the outer coil provides protection for said inner coil and the vibration-sensitive cable therein.

2. An intrusion detection barrier as in claim 1 wherein the outer coil is defined by a helical barbed tape comprising a central helically formed supporting portion with said plurality of barb clusters at spaced apart locations therealong.

3. An intrusion detection barrier as in claim 2 wherein the barb clusters of said outer coil define a plurality of barbs which are offset relative to the central supporting portion of said outer coil.

4. An intrusion detection barrier as in claim 3 wherein adjacent loops of the outer coil are retained generally in proximity to one another at a plurality of locations thereabout for defining a concertina-type coiled barbed tape.

5. An intrusion detection barrier as in claim 4 wherein the adjacent loops of the outer coil are retained in proximity to one another by clip means.

6. An intrusion detection barrier as in claim 1 wherein the supporting means extending generally radially between the inner and outer coils comprise metallic straps connected respectively to the inner and outer coils.

7. An intrusion detection barrier as in claim 6 wherein the straps are connected to the inner and outer coils by welding.

8. An intrusion detection barrier as in claim 6 wherein the straps are lockingly engaged about said inner and outer coils for retaining the inner coil generally centrally within the outer coil.

9. An intrusion detection barrier as in claim 1 further comprising a filler material disposed intermediate the cable and the inner coil's supporting tape for preventing the accumulation of liquids therebetween and for facilitating the transmission of vibrations to the cable.

10. An intrusion detection barrier as in claim 9 wherein the filler comprises an elastomeric material.

11. An intrusion detection barrier as in claim 1 wherein the radially extending supports between the inner and outer coils are provided with barbs for enhanced protection of said barrier.

12. An intrusion detection barrier as in claim 1 further comprising electrical connector means on opposed ends of said inner coil for electrically connecting the cable in said inner coil to another cable.

13. An intrusion detection device comprising a plurality of the intrusion detection barriers of claim 1 electrically and mechanically connected to one another.

14. An intrusion detection barrier as in claim 1 further comprising signal processor means for processing vibration signals sensed by said cable.

15. An intrusion detection barrier as in claim 14 further comprising alarm means for generating an alarm in response to selected vibrations sensed by said cable.

16. An intrusion detection barrier comprising:

an outer coil defined by a helical barbed tape having a helically formed central supporting portion and a plurality of clusters of barbs at spaced apart locations therealong, said helical barbed tape defining a plurality of continuous coils, with adjacent coils being retained in proximity to one another at a plurality of locations thereabout;

metallic straps securely connected to said outer coil and extending radially inwardly therefrom at a plurality of spaced apart locations along said outer coil;

an inner coil disposed generally centrally within the helix defined by said outer coil and supported therein by said straps, said inner coil comprising a vibration-sensitive cable and a helical barbed tape, said helical barbed tape comprising a central supporting portion generally wrapped around said cable and a plurality of barbs extending from said central supporting portion, whereby vibrations in said outer coil are transmitted through said straps and sensed by the vibration-sensitive cable formed within said inner coil, and whereby the barb clusters on said outer coil provide protection for the inner coil and the cable therein.

17. An intrusion detection barrier as in claim 16 further comprising a filler material intermediate said cable and said central supporting portion of said inner coil.

18. An intrusion detection barrier as in claim 16 wherein said straps are defined by generally planar elongated strips of metal securely connected to both said inner and outer coils at a plurality of locations thereabout.

19. An intrusion detection barrier comprising:

a helical barbed tape having an elongated helically formed central supporting portion and a plurality of barb clusters extending from said central supporting portion, said central supporting portion being formed to define a generally annular cross section at points along the length of said central supporting portion;

a vibration-sensitive cable disposed in the annularly formed central supporting portion of the helical barbed tape; and a filler material intermediate the vibration-sensitive cable and the barbed tape, whereby the filler material prevents accumulation of moisture between the cable and the barbed tape and enhances the transmission of vibrations from the barbed tape to the cable.

20. An intrusion detection barrier as in claim 19 wherein the helical barbed tape is of unitary construction.

21. An intrusion detection barrier as in claim 19 wherein the filler material is an elastomeric material.

22. An intrusion detection barrier as in claim 19 wherein the filler comprises silicone.

23. An intrusion detection barrier as in claim 19 further comprising a fence, said helical barbed tape being mounted to the fence.

24. An intrusion detection barrier as in claim 19 wherein the helical barbed tape defines a first helical barbed tape, said barrier further comprising a second helical barbed tape generally concentric with the first helical barbed tape and support means extending between the first and second helical barbed tapes for maintaining the generally concentric relationship therebetween.

25. An intrusion detection barrier as in claim 24 wherein the first helical barbed tape is disposed generally concentrically within the second helical barbed tape.

26. An intrusion detection barrier as in claim 24 wherein the support means comprise a plurality of generally radially extending straps.

27. A method for forming an intrusion detection barrier, said method comprising the steps of:

providing a barbed tape having an elongated central supporting portion and a plurality of barb clusters extending unitarily therefrom;

forming a longitudinally extending channel in said central supporting portion;

feeding a controlled amount of an initially flowable filler material into the channel;

placing an elongated vibration-sensitive cable in the channel; and forming the central supporting portion of the barbed tape around the vibration-sensitive cable and the filler material, whereby the filler material prevents accumulation of moisture between the cable and the barbed tape and enhances the transmission of vibrations to the cable.

28. A method as in claim 27 wherein the filler material is elastomeric.

29. A method as in claim 28 wherein the filler material comprises silicone.

* * * * *